US006388572B1

(12) United States Patent
Salter

(10) Patent No.: US 6,388,572 B1
(45) Date of Patent: May 14, 2002

(54) SELECTIVELY POSITIONAL INTRUDER ALARM FOR SLIDING WINDOWS AND DOORS

(76) Inventor: Annie L. Salter, 8201 W. Belfort, #1258, Houston, TX (US) 77071

( * ) Notice: Subject to any disclaimer, the term of this patent is extended or adjusted under 35 U.S.C. 154(b) by 0 days.

(21) Appl. No.: 09/883,052

(22) Filed: Jun. 18, 2001

(51) Int. Cl.[7] ..... G08B 13/08

(52) U.S. Cl. ..... 340/546; 340/545.1; 340/686.1; 340/545.7; 340/545.8; 340/545.9

(58) Field of Search ..... 340/546, 545.1, 340/541, 542, 543, 545.7, 545.8, 545.9, 547, 545.2, 693.5, 527, 528, 689, 686.1; 200/61.93

(56) References Cited

U.S. PATENT DOCUMENTS

| | | | | | |
|---|---|---|---|---|---|
| 4,149,156 | A | | 4/1979 | Biasucci | |
| 4,553,134 | A | * | 11/1985 | Holt | 340/545 |
| 4,837,557 | A | * | 6/1989 | Striebel | 340/546 |
| 4,841,673 | A | * | 6/1989 | Tjomsland | 49/141 |
| 4,888,578 | A | * | 12/1989 | Conemac | 340/546 |
| 5,164,705 | A | | 11/1992 | Dunagan et al. | |
| 5,552,768 | A | | 9/1996 | Mikiel et al. | |
| 5,872,514 | A | * | 2/1999 | Neas | 340/545.1 |
| 6,075,440 | A | * | 6/2000 | Carroll | 340/546 |

* cited by examiner

*Primary Examiner*—Daniel J. Wu
*Assistant Examiner*—Daniel Previl
(74) *Attorney, Agent, or Firm*—Kenneth A. Robby

(57) ABSTRACT

A portable selectively positional intruder alarm for sliding windows and doors is installed in a window or door frame with its longitudinal axis parallel to a sliding window sash or door at a selected distance therefrom to provide security while allowing the window to be partially open for ventilation and will emit an alarm either when the window or door is opened further or when the device is removed from the window or door frame. The device has a telescoping tubular housing with end plugs at each end. One end plug is fixed to the housing and the other is slidably mounted in the end of the housing. The end plugs are removably held against the opposed tracks of the sliding window sash or sliding door by the force of a compression spring within the housing. An alarm circuit disposed in the outer tube includes a battery, an audio transducer, a normally-open switch, a normally-closed switch, and may also include a visual alarm and battery condition indicator. An actuator pin on the movable frame surface of the sliding window sash or door engages the normally-open switch upon movement of the frame surface a distance toward the housing such that the partially open or fully closed window sash or door may be opened a distance less than the selected distance for ventilation without sounding the alarm and, upon further opening the window sash or door a distance approximate to the selected distance, the alarm is activated. The sliding end plug is engaged with the normally-closed switch when the device is installed in the track and, when the device is removed, is disengaged to activate the alarm.

8 Claims, 5 Drawing Sheets

SELECTIVELY POSITIONAL INTRUDER ALARM FOR SLIDING WINDOWS AND DOORS

BACKGROUND OF THE INVENTION

1. Field of the Invention

This invention relates generally to window and door mounted alarm apparatus, and more particularly to a portable selectively positional intruder alarm for sliding windows and doors which can be installed parallel to the movable window sash or sliding door at selected distances therefrom to provide security while allowing the window to be partially open and will emit an alarm either when the window or door is opened further or when the device is removed from the window or door frame.

2. Brief Description of the Prior Art

Conventional sliding windows, such as single hung, double hung, and "slider" windows, are constructed from two window sashes disposed in a common frame. In single hung and double hung windows, a lower window sash slides vertically in its own track relative to an upper window sash. In a "slider" window and patio door, a left-hand or right-hand sash slides horizontally in its track relative to a laterally opposed fixed sash. In these types of constructions, one window-sash or door, with its corresponding pane or panes of glass is external to the other. Typically, the upper window sash or fixed window sash is the outer facing member, with respect to the dwelling interior, and when the lower or movable window sash is completely closed, its upper edge is flush with the lower edge of the upper or fixed window sash.

Many people are victimized by intruders that gain entry through sliding windows and doors. Most sliding windows and doors have locks to secure them in a closed position. However few, if any, conventional sliding windows and doors provide for a lock in a partially opened position. It is often desirable to have a sliding window or door partially open to provide cool fresh air and air circulation, but this can sometimes be dangerous because an intruder can simply push the window or door open to gain access to the dwelling.

There are several patents that disclose various devices to lock sliding windows and doors in the closed position, and alarm devices for use on sliding windows and doors. Most prior art intrusion alarms for sliding windows and doors are designed so that they are activated when they are removed from a fully closed window or door, or when the window or door is moved from a fully closed position, and are not capable of providing an alarm function when the window or door is in a partially open position.

Holt, U.S. Pat. No. 4,553,134, Conemac, U.S. Pat. No. 4,888,578, and Neas, U.S. Pat. No. 5,872,514 disclose telescopic tubular alarm devices for sliding windows or doors that are spring biased between the window or door frame and the closed window or door and are activated when removed or an attempt is made to open the closed window or door. These devices are not suited for providing an alarm function when the window or door is in a partially open position, since they are activated when they are compressed.

Blasucci, U.S. Pat. No. 4,149,156 discloses a window alarm employing a releasably mounted plunger switch. The plunger switch is releasably held against the inner surface of the outer section (upper sash) of a double-hung window or sliding door; by a suction cup, in an exemplary embodiment. Movement of the inner section (lower sash) with respect to the outer section (upper sash) dislodges the suction cup, releasing the switch and allowing it to close thereby actuating a signaling means to generate an alarm signal.

Mikiel et al, U.S. Pat. No. 5,552,768 discloses a portable window wedge with alarm comprising a molded resilient triangular block having a suction cup securely fastened to its base. The suction cup is fastened to the base so that a jamming tapered tip on the triangular block is angled slightly toward the mounting surface. The portable sliding window lock is mounted on the vertical surface of a flat window pane adjacent the frame of a sliding window to intercept and jam the window frame with the sliding window partially open. This prevents forcing the partially open window any further open to gain access to an area. An optional feature includes an audible alarm mounted on the resilient triangular block which is set-off by a switch activated by force applied to a sliding glass window engaging the resilient triangular block. The audible alarm is activated by a contact switch, motion sensing switch or pressure switch embedded in the molded resilient triangular block.

Dunagan et al, U.S. Pat. No. 5,164,705 discloses an anti-intrusion window with a built-in alarm comprising a window frame assembly adapted to be attached to a building structure, first and second sash assemblies supported by the frame assembly and relatively movable with respect to each other, a position indicator supported by one sash, a sensor supported by the other sash and an alarm signal generator activated whenever the position indicator and the sensor are at least momentarily adjacent each other. Multiple windows are coupled to a second alarm signal generator which produces an audible alarm when the first alarm signal generator transmits an alarm signal.

The present invention is distinguished over the prior art in general, and these patents in particular by a portable selectively positional intruder alarm for sliding windows and doors that is installed in a window or door frame with its longitudinal axis parallel to a sliding window sash or door at a selected distance therefrom to provide security while allowing the window to be partially open for ventilation and will emit an alarm either when the window or door is opened further or when the device is removed from the window or door frame. The device has a telescoping tubular housing with end plugs at each end. One end plug is fixed to the housing and the other is slidably mounted in the end of the housing. The end plugs are removably held against the opposed tracks of the sliding window sash or sliding door by the force of a compression spring within the housing. An alarm circuit disposed in the outer tube includes a battery, an audio transducer, a normally-open switch, a normally-closed switch, and may also include a visual alarm and battery condition indicator. An actuator pin on the movable frame surface of the sliding window sash or door engages the normally-open switch upon movement of the frame surface a distance toward the housing such that the partially open or fully closed window sash or door may be opened a distance less than the selected distance for ventilation without sounding the alarm and, upon further opening the window sash or door a distance approximate to the selected distance, the alarm is activated. The sliding end plug is engaged with the normally-closed switch when the device is installed in the track and, when the device is removed, is disengaged to activate the alarm.

SUMMARY OF THE INVENTION

It is therefore an object of the present invention to provide an intruder alarm for sliding windows and doors, which will provide security while allowing the window or door to be partially open for ventilation and will activate an alarm when the window is opened further.

It is another object of this invention to provide an intruder alarm for sliding windows, which can be installed in a conventional window or door frame parallel to the movable window sash or door at selected distances therefrom.

Another object of this invention is to provide a portable selectively positional intruder alarm for sliding windows and doors which is installed in a conventional window frame parallel to the movable window sash or door and will activate an alarm if removed from the window or door frame.

Another object of this invention is to provide a portable selectively positional intruder alarm for sliding windows and doors which is installed in a conventional window or door frame parallel to the movable window sash or door and will activate an alarm either if the window or door is opened beyond a predetermined distance, or if it is removed from the window or door frame.

Another object of this invention is to provide a self-contained intruder alarm for sliding windows and doors, which can be quickly and easily installed in a conventional window or door frame without the use of tools and does not require any wiring.

Another object of this invention to provide a self-contained portable intruder alarm for sliding windows and doors, which is easily transported for use at various temporary locations, such as a summer home, vacation cottage, hotel or motel.

A further object of this invention is to provide an intruder alarm for sliding windows and doors which is of tubular construction and installed in existing window frames parallel to the movable window sash or door and will closely conform to the appearance of the existing window or door frame construction.

A still further object of this invention is to provide a portable self-contained intruder alarm for sliding windows and doors, which is simple in construction, inexpensive to manufacture and rugged and reliable in operation.

Other objects of the invention will become apparent from time to time throughout the specification and claims as hereinafter related.

The above noted objects and other objects of the invention are accomplished by a portable selectively positional intruder alarm for sliding windows and doors that is installed in a window or door frame with its longitudinal axis parallel to a sliding window sash or door at a selected distance therefrom to provide security while allowing the window to be partially open for ventilation and will emit an alarm either when the window or door is opened further or when the device is removed from the window or door frame. The device has a telescoping tubular housing with end plugs at each end. One end plug is fixed to the housing and the other is slidably mounted in the end of the housing. The end plugs are removably held against the opposed tracks of the sliding window sash or sliding door by the force of a compression spring within the housing. An alarm circuit disposed in the outer tube includes a battery, an audio transducer, a normally-open switch, a normally-closed switch, and may also include a visual alarm and battery condition indicator. An actuator pin on the movable frame surface of the sliding window sash or door engages the normally-open switch upon movement of the frame surface a distance toward the housing such that the partially open or fully closed window sash or door may be opened a distance less than the selected distance for ventilation without sounding the alarm and, upon further opening the window sash or door a distance approximate to the selected distance, the alarm is activated. The sliding end plug is engaged with the normally-closed switch when the device is installed in the track and, when the device is removed, is disengaged to activate the alarm.

DESCRIPTION OF THE PREFERRED EMBODIMENT

Figure 1:
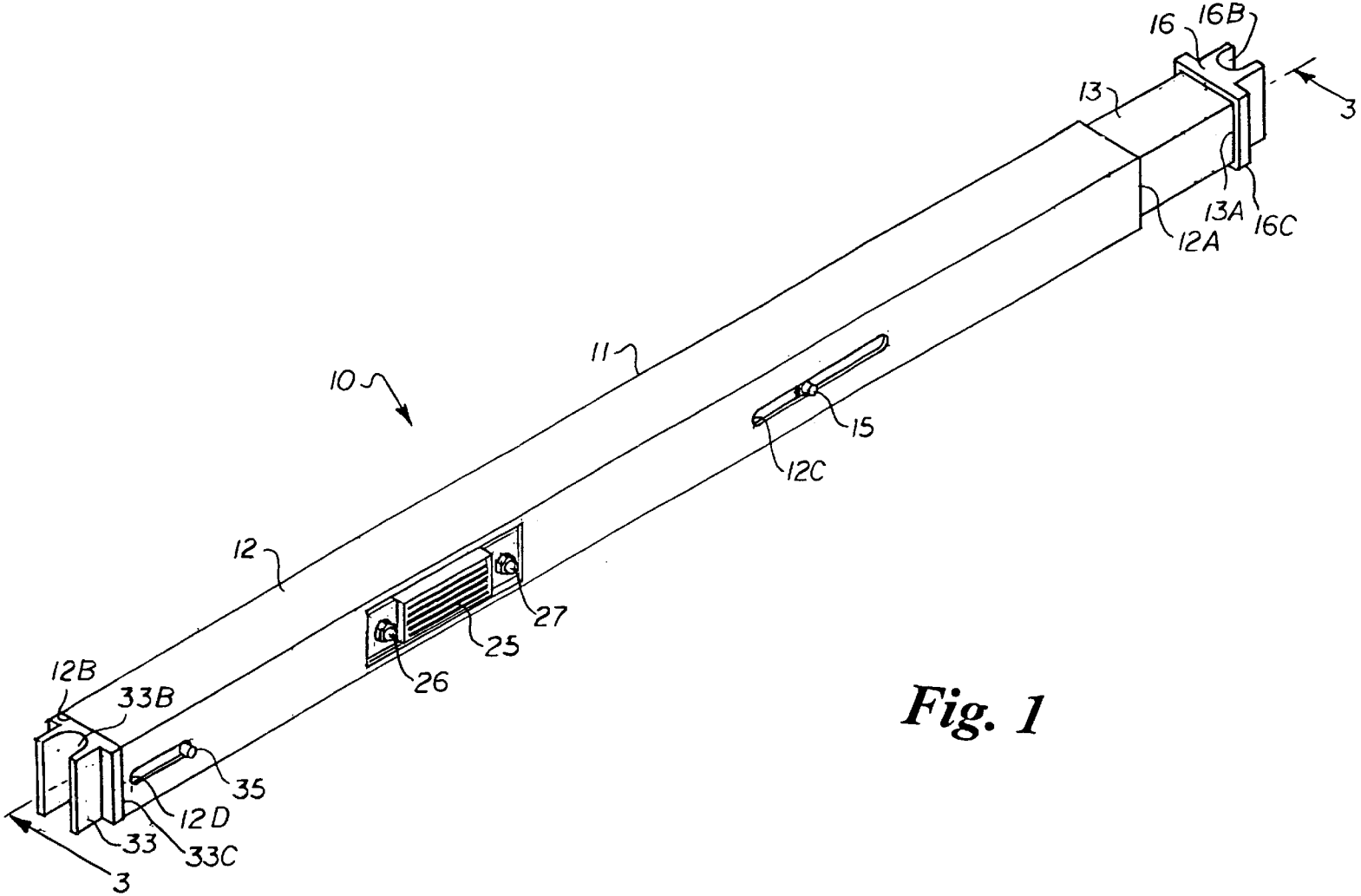
FIG. 1 is an isometric view of the intruder alarm for sliding windows and doors, in accordance with the present invention.

Referring to the drawings by numerals of reference there is shown in FIGS. 1 through 6, a preferred intruder alarm 10 for sliding windows and doors. The alarm device 10 has a tubular housing 11 formed of a first or outer elongate hollow tubular section 12 having opposed first and second ends 12A and 12B and a shorter second or inner hollow tubular section 13 telescopically received in the first end 12A thereof. The tubular sections 12 and 13 are preferably formed of square tubing and made of aluminum, plastic, or other suitable lightweight material. A pair of slots 12C and 12D are formed in the laterally opposed side walls of the outer elongate tubular section 12, near each of its ends 12A and 12B, respectively.

A pair of resilient tangs 14 extend axially outward from laterally opposed side walls of the shorter inner tubular section 13, respectively, and are provided with lateral protrusions or buttons 15 near their outer ends.

A first end plug 16 is secured to the outer end 13A of the inner tubular section 13. The inner end 16A of the end plug 16 is a generally square configuration and is secured in the outer end of the inner tubular section 13 by conventional means, such as a pin, epoxy, or other suitable means known in the art. The outer end of the end plug 16 is sized and shaped to be received in the sash channel or track on one side of a conventional window frame, and may be provided with a vertical recess 61B to accommodate a vertical rib, should one be present in the existing channel or track. The end plug 16 has an intermediate portion in the form of a raised peripheral flange 16C which has an outer peripheral dimension approximately the same as the outer peripheral dimension of the tubular section 12.

An elongate rod 17 having one end secured to the inner end 16A of the end plug 16 extends axially through the shorter inner tubular section 13 and a distance beyond its inward end 13B. A compression spring 18 surrounds the rod 17.

Figure 2:
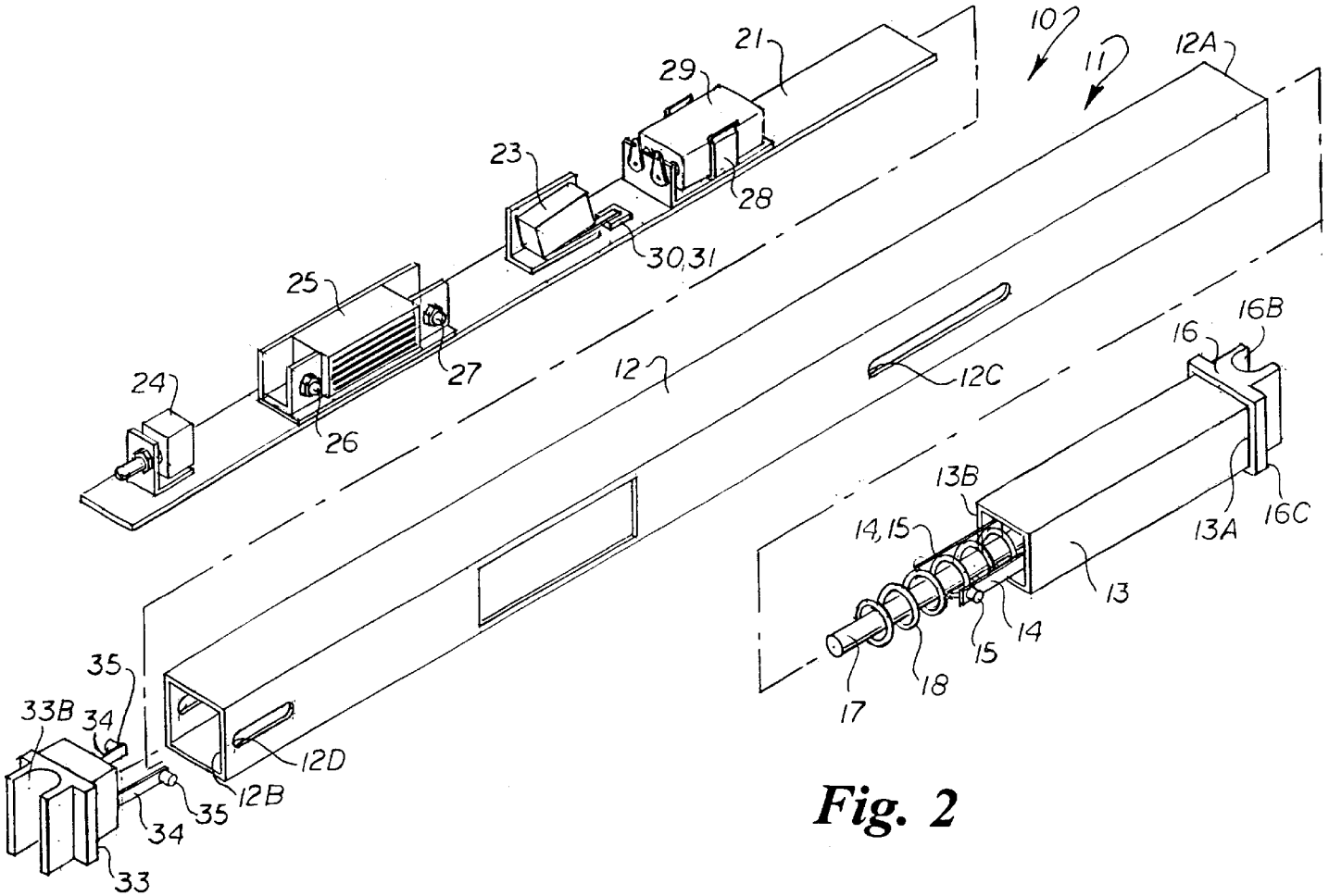
FIG. 2 is an exploded isometric view of the intruder alarm, shown in an unassembled condition.
Figure 3:
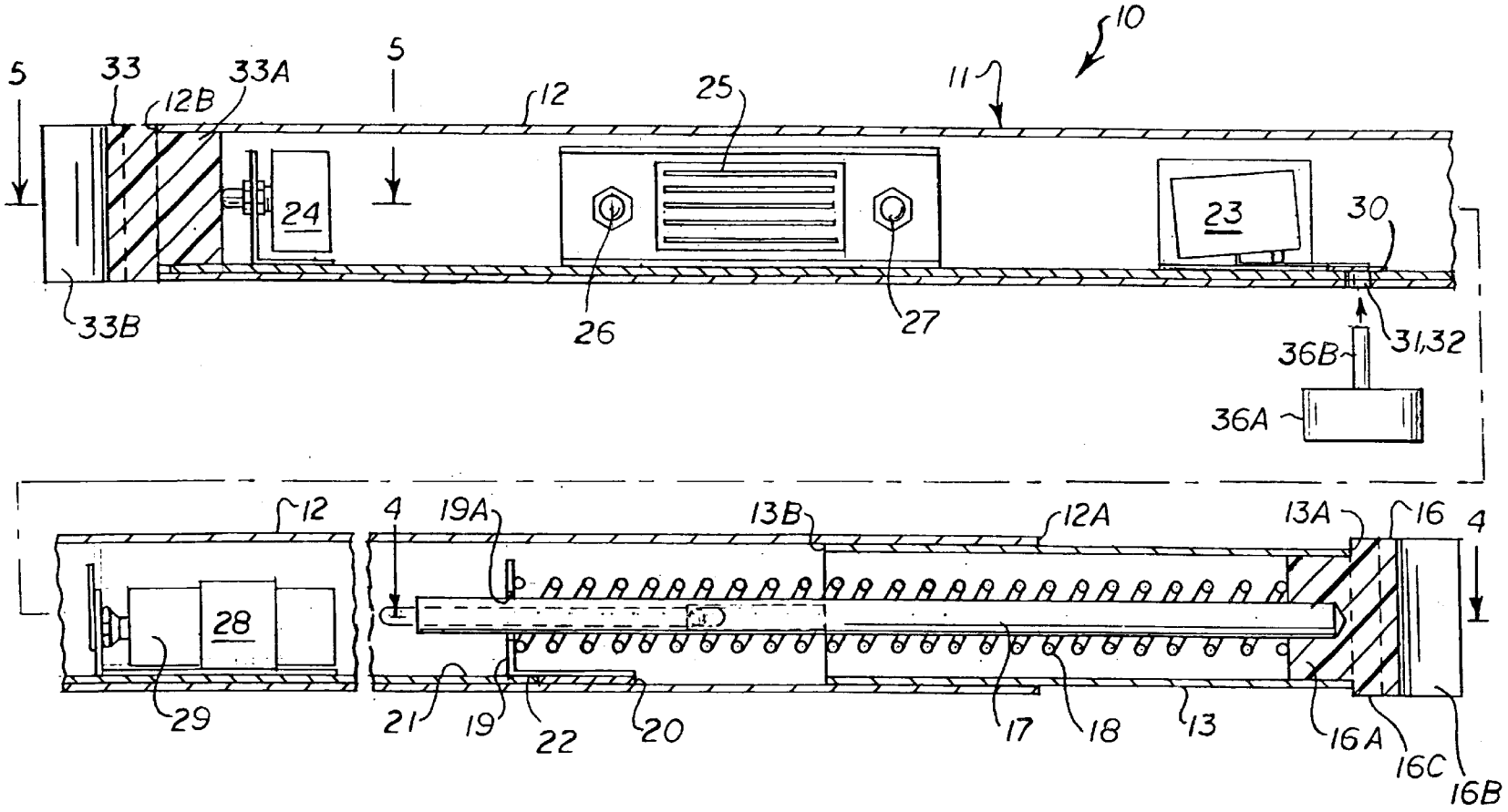
FIG. 3 is a longitudinal cross section through the intruder alarm, taken along line 3—3 of FIG. 1.
Figure 6:
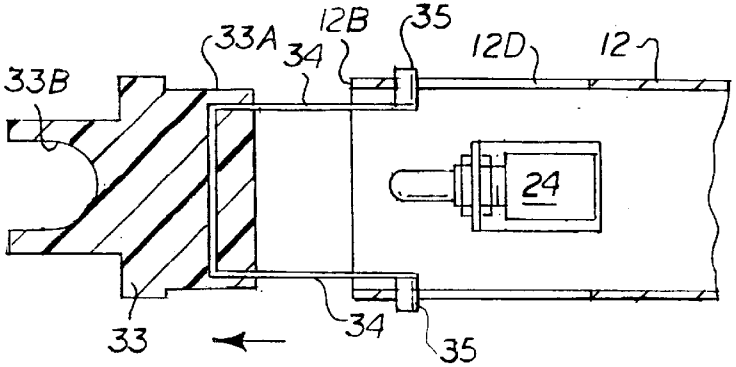
FIG. 6 is a longitudinal cross section similar to FIG. 5, showing the end plug in a loosened position outer position.
Figure 5:
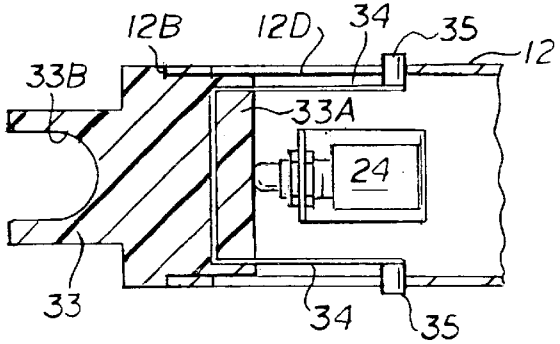
FIG. 5 is a longitudinal cross section through the second end and the end plug of the intruder alarm in its innermost position, taken along line 5—5 of FIG. 3.
Figure 4:
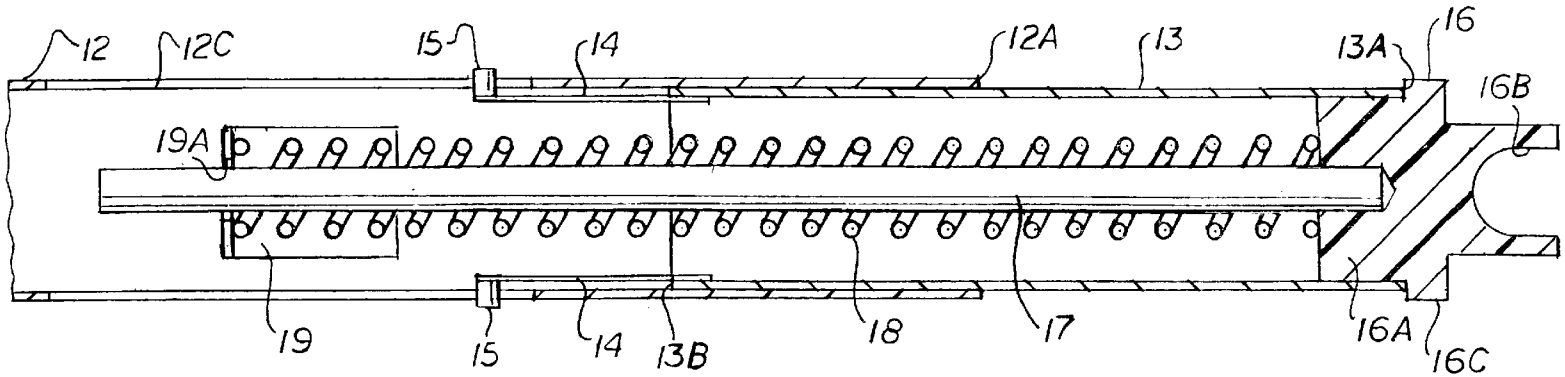
FIG. 4 is a longitudinal cross section through the first end and the shorter tubular section of the intruder alarm, taken along line 4—4 of FIG. 3.

As shown in FIGS. 3 and 4, a generally L-shaped spring retainer bracket 19 and a lower rectangular spacer 20 are secured to the bottom wall of the elongate outer tubular section 12 a distance inwardly from its first outer end 12A. The upstanding leg of the bracket 19 is provided with a central hole 19A therethrough for slidably receiving the inward facing end of the rod 17. As best seen in FIGS. 2, 3, and 4, the inner tubular section 13 is installed in the outer tubular section 12 by squeezing the buttons 15 laterally inward to flex the spring-biased tangs 14, inserting them in the open end 12A, then releasing them and sliding the tubular section 13 into the open end 12A, until the buttons 15 snap laterally outward into the slots 12C. Thereafter, the buttons 15, ride in the slots 12C upon relative axial movement between the tubular sections 12 and 13, and prevent the tubular sections from separating completely. When necessary, the inner tubular section 13 may be removed by squeezing the buttons 15 inwardly to clear the slots while pulling it axially outward from the outer tubular section 12.

In the assembled condition, the compression spring 18 has one end engaged on the inner end 16A of the end plug 16 and its opposed end on the upstanding leg of the spring retainer bracket 19. The compression spring 18 urges the inner tubular section 13 and end plug 16 to an outwardly extended position relative to the end 12A of the outer tubular section 12.

As shown in FIGS. 2 and 3, the electrical components of the alarm device 10 are mounted on a rigid thin rectangular mounting strip 21 formed of aluminum, plastic, or other suitable lightweight material, which is slidably received within the elongate outer, tubular section 12 through its second outer end 12B. The spacer 20 beneath the L-shaped bracket 19 elevates the horizontal leg of the bracket to define a slot 22 to receive the inward facing end of the mounting strip 21 and hold it against the bottom wall of the tubular section 12.

The electrical components include a first normally-open (NO) lever-type micro switch 23, a normally-closed (NC) plunger switch 24, and an audio transducer or audible alarm 25. A visual alarm light 26 and a low-battery indicator light 27 may also be included. The visual alarm light 26 may also include a flasher unit. A battery clip 28 secured to the mounting strip 21 receives a 9-volt DC battery 29. A small tab 30 is secured to the outer end of the lever of the normally-open micro switch 23 and is disposed above a hole 31 in the mounting strip 21 and an axially aligned hole 32 in the bottom wall of the outer tubular section 12. The normally-closed plunger switch 24 is disposed near an outer end of the mounting strip 21 and its plunger faces the open end 12B of the outer tubular section 12 (FIG. 3).

A second end plug 33 is received in the outer end 12B of the elongate outer tubular section 12. The inner end 33A of the end plug 33 is a generally square configuration and is sized to be slidably received on the interior surface of the top wall and side walls of the tubular section 12 and the top surface of the outer facing end of the mounting strip 21 and hold it against the bottom wall of the outer tubular section 12.

A pair of laterally opposed resilient tangs 34 extend axially from the inner end 33A of the end plug 33, and are provided with lateral protrusions or buttons 35 near their outer ends. The outer end of the end plug 33 is sized and shaped to be received in the sash channel or track on one side of a conventional window frame, and may be provided with a vertical recess 33B to accommodate a vertical rib, should one be present in the existing channel or track. The end plug 33 has an intermediate portion in the form of a raised peripheral flange 33C which has an outer peripheral dimension approximately the same as the outer peripheral dimension of the tubular section 12.

The end plug 33 is installed in the outer tubular section 12 by squeezing the buttons 35 laterally inward to flex the spring-biased tangs 34, inserting them in the open end 12B, then releasing them and sliding the end plug into the open end until the buttons 35 snap laterally outward into the slots 12D. Thereafter, the buttons 35 ride in the slots 12D and prevent complete separation of the end plug 33 and tubular section 12. The end plug 33 can be manually removed by squeezing the buttons 35 inwardly to clear the slots while pulling the end plug axially outward from the outer tubular section 12 so that the mounting strip 21 may be pulled out to change the battery 29 when necessary. When the alarm device 10 is installed in a window and the end plug 33 is in its innermost position (FIG. 5), the plunger of the normally-closed plunger switch 24 is depressed by the end plug and its contacts are opened.

Figure 7:
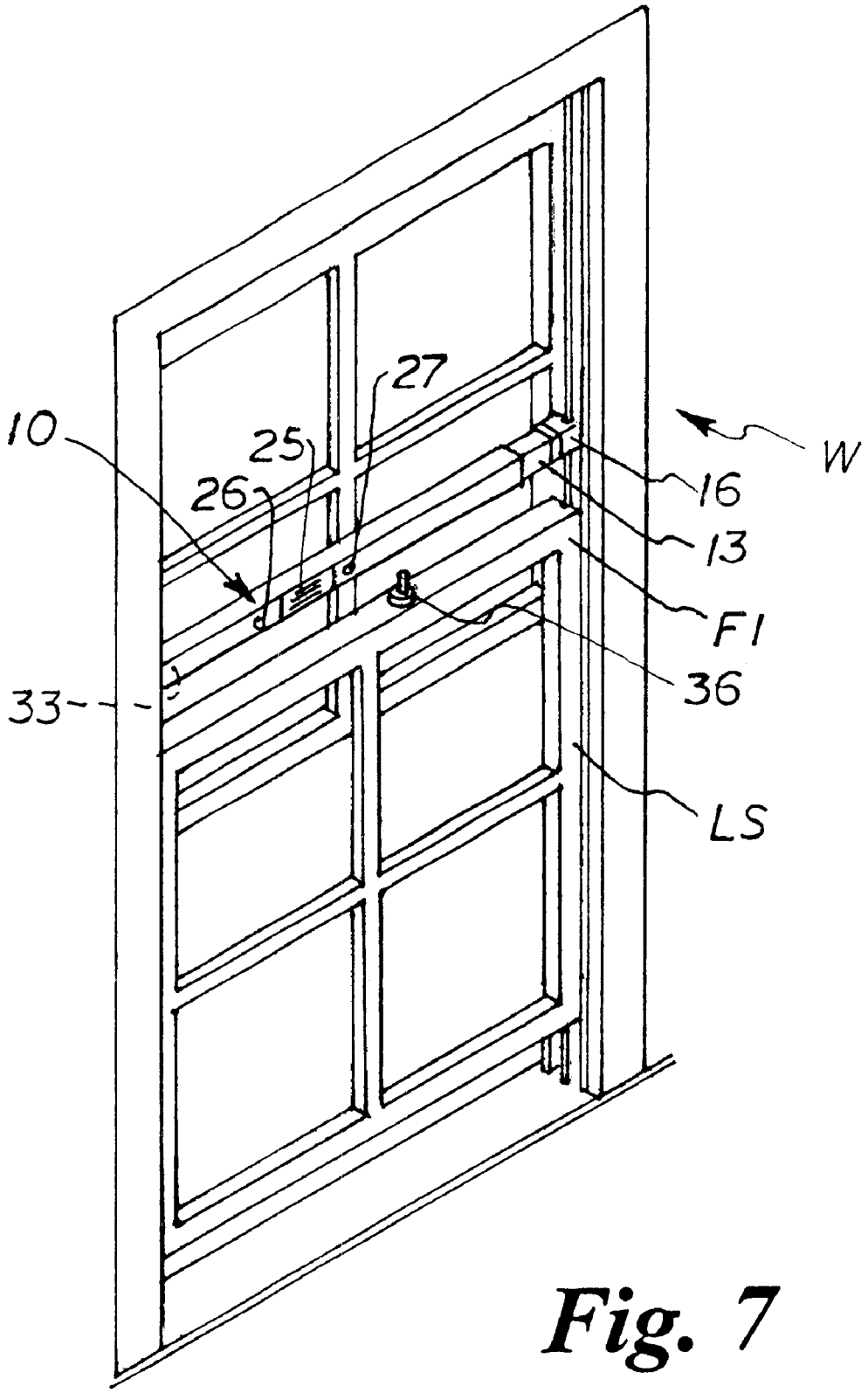
FIG. 7 is a perspective view, showing the intruder alarm installed horizontally in a window frame with the window partially open.

As seen in FIGS. 3 and 7, the outer end of the lever of the micro switch 23 is raised by a small actuator pin 36. The actuator pin 36 has a base portion 36A and an upstanding pin portion 36B extending a short distance upwardly therefrom. The base 36A is fixed to the top surface of the top frame member F1 of the lower window sash LS by double sided tape, or other conventional mounting means. The pin portion 36B is sized to pass upwardly through the hole 32 in the bottom wall of the outer tubular section 12 and the hole 31 in the mounting strip 21 and push the tab 30 at the outer end of the lever of the normally-open micro switch 23 upwardly to actuate the audible alarm when the window sash is raised a sufficient distance.

Preferably, the height of the actuator pin 36 is greater than the height of the window latches that may exist on the top surface of the sash frame for locking the window in its closed position. Alternatively, the actuator pin 36 may be replaced by a pin that is attached at its top end to the pad 30 at the end of the lever of the switch 23.

The electrical wiring circuit for the electrical components is conventional and well known by those skilled in the art, and therefore not shown in detail. The normally-open lever-type switch 23 and the normally closed plunger switch 24 are connected in parallel with the terminals of the battery 29 and in series with the audible alarm 25 such that when the plunger of the normally-closed plunger switch 24 is extended a circuit is completed to sound the alarm and to break the circuit when the plunger is depressed. When the lever of the normally-open lever-type switch 23 is raised by the actuator pin 36 a circuit is completed to sound the alarm, and the circuit is broken when the lever is lowered. Preferably, the switches 23 and 24 are connected with the audible alarm 25 through a time delay relay circuit or switch such that the audible alarm will continue to sound for a period of time after the alarm has been triggered.

The visual alarm light 26 may be connected in parallel with the audible alarm 25 to indicate visually that the alarm circuit has been triggered. A low-voltage detection circuit and indicator light 27 may also be connected with the terminals of the battery 29 to visually indicate when the battery voltage has dropped below a predetermined threshold and a new battery is required.

It should be understood from the foregoing description that the present intruder alarm 10 will produce a sound or a sound and a visual signal either when the lower window sash has been raised a sufficient distance, or when the device has been removed from the window frame.

As shown in FIG. 7, the intruder alarm device 10 is installed horizontally above the top frame member F1 of the lower window sash LS in an existing window frame of a sliding window W by placing the first end plug 16 into the sash channel or track on one lateral side of the window frame and pushing it toward the channel or track to retract the shorter inner tubular section 13, placing the second end plug 33 into channel or track on the opposed lateral side of the frame, and then releasing the device. The pressure of the compression spring 18 urges the opposed end plugs 16 and 33 into firm spring-biased engagement in the laterally opposed window sash channels or tracks. When the alarm device 10 is installed in the window W and the end plug 33 is in its innermost position, the plunger of the normally-closed switch 24 is depressed by the end plug and its contacts are opened. When the device is removed from the window frame, the end plug 33 is loosened, the plunger of the plunger switch 24 is extended and a circuit is completed to sound the alarm or alarm and visual signal.

The intruder alarm device 10 may be selectively positioned directly above the top frame member F1 of the lower window sash LS when the window is partially open, or at a selected distance vertically above the top end of the sash to allow the window to be opened further. When the window sash is raised the predetermined distance, the lever of the normally-open lever-type switch 23 is raised by the actuator pin 36 and a circuit is completed to sound the alarm 25 or alarm and visual signal 26. Thus, the present intruder alarm provides security while allowing the window to be partially open for ventilation.

Although the intruder alarm has been shown and described, by way of example, as being used with windows having a lower window sash that slides vertically relative to an upper window sash, it should be understood that it may also be used in a "slider" window, wherein a left-hand or right-hand sash slides horizontally in its track relative to a laterally opposed fixed sash. In these types of constructions, the intruder alarm would be installed vertically with its longitudinal axis parallel with the lateral side of the movable window sash or door frame and its end plugs would be configured to be received in the horizontal channels or tracks. It should also be understood that longer intruder alarms may be made of sufficient length for use with sliding patio doors wherein it would be installed vertically with its longitudinal axis parallel with the lateral side of the movable patio door frame, and its end plugs would be configured to be received in the horizontal channels or tracks.

While this invention has been described fully and completely with special emphasis upon preferred embodiments, it should be understood that within the scope of the appended claims the invention may be practiced otherwise than as specifically described herein.

What is claimed is:

1. A selectively positional alarm device for sliding windows and doors, comprising:

an elongate telescoping tubular housing having a longitudinal axis and including a hollow outer tube having a first end and a second end, and an inner tube having a first end and a second end, said first end of said inner tube being slidably received in said first end of said outer tube, said second end of said inner tube extending from said first end of said outer tube;

a first end plug fixed to said second end of said inner tube, and a second end plug slidably mounted in said second end of said outer tube, each said plug having an outer end sized and shaped to be received in a track of a sliding window sash or sliding door;

a compression spring disposed within said outer and inner tubes to urge them into an opposed extended position such that said end plugs are removably held against said track only by the force of said compression spring;

an alarm circuit disposed in said outer tube including a battery, an audio transducer electrically connected with said battery, and a normally-open switch located in said outer tube having normally-open contacts connected between said audio transducer and said battery;

said tubular housing positioned a selected distance from a frame surface of said sliding window sash or sliding door in either a partially open position or fully closed position with its said longitudinal axis parallel to the plane of said frame surface; and actuator means disposed between the frame surface of said sliding window sash or sliding door and said normally-open switch to close said contacts and connect said battery with said audio transducer upon movement of said frame surface a distance toward said housing such that said partially open or fully closed sliding window sash or sliding door may be opened a distance less than said selected distance for ventilation without sounding the audible alarm, and upon further opening said window sash or door a distance approximate to said selected distance said audio transducer sounds an audible alarm.

2. The alarm device according to claim 1, wherein said alarm circuit further includes a depressible switch located in said outer tube near said outer tube second end having normally-closed contacts electrically connected between said battery and said audio transducer; and said second end plug is slidably mounted in said second end of said outer tube in a loose fashion allowing it to slide relative to said second end of said outer tube between an innermost position when housing is installed and said end plugs are removably held against said track by the force of said compression spring and an outermost position when said end plugs are removed from said track;

in said innermost position said second end plug being engaged with said depressible switch to maintain its said normally-closed contacts in an open condition to prevent activation of said audio transducer; and in said outermost position said second end plug being spaced from said depressible switch to allow its said normally-closed contacts to close and connect said battery with said audio transducer and sound an audible alarm when said end plugs are removed from said track.

3. The alarm device according to claim 2, further comprising:

a spring-biased button connected with said second end plug and urged laterally outward to extend through a longitudinal slot in said outer tube to allow axial movement of said second end plug relative to said outer tube between said innermost and said outermost positions, and said button being pressed laterally inward toward the interior of said outer tube to allow removal of said second end cap from said outer tube.

4. The alarm device according to claim 1, further comprising:

a spring-biased button connected with said inner tube and urged laterally outward to extend through a longitudinal slot in said outer tube to allow axial telescoping movement of said inner tube relative to said outer tube, and said button being pressed laterally inward toward the interior of said outer tube to allow removal of said inner tube from said outer tube.

5. The alarm device according to claim 1, wherein said actuator means comprises a pin on said frame surface extending perpendicular thereto, said pin being of sufficient length to extend through an aperture in said outer tube and close said contacts of said normally-open switch upon opening said window sash or door a distance approximate to said selected distance.

6. The alarm device according to claim 1, wherein said alarm circuit further includes an alarm light electrically connected in parallel with said audio transducer and visible from the exterior of said outer tube to provide a visual indication that said sliding window sash or sliding door has been opened a distance approximate to said selected distance.

7. The alarm device according to claim 1, wherein said alarm circuit further includes a low-voltage detection circuit and battery condition indicator light electrically connected with said battery to visually indicate when said battery voltage has dropped below a predetermined threshold.

8. The alarm device according to claim 1, wherein said outer tube and said inner tube are each formed of square tubing.

* * * * *